US008870363B2

(12) United States Patent
Ipponyari et al.

(10) Patent No.: US 8,870,363 B2
(45) Date of Patent: Oct. 28, 2014

(54) CUTTING DEVICE AND CUTTING METHOD THEREOF

(75) Inventors: Tadanori Ipponyari, Nagano (JP); Shinya Nishizawa, Nagano (JP); Kosuke Murai, Nagano (JP); Takashi Higuchi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 160 days.

(21) Appl. No.: 13/391,819

(22) PCT Filed: May 25, 2010

(86) PCT No.: PCT/JP2010/003479

§ 371 (c)(1),
(2), (4) Date: Feb. 23, 2012

(87) PCT Pub. No.: WO2011/027493

PCT Pub. Date: Mar. 10, 2011

(65) Prior Publication Data

US 2012/0148326 A1 Jun. 14, 2012

(30) Foreign Application Priority Data

Sep. 1, 2009 (JP) ..... 2009-201303

(51) Int. Cl.

| | |
|---|---|
| ***B41J 2/01*** | (2006.01) |
| ***B41J 2/385*** | (2006.01) |
| ***B41F 13/56*** | (2006.01) |
| ***B41J 11/70*** | (2006.01) |
| ***B41J 11/66*** | (2006.01) |
| ***B26D 1/04*** | (2006.01) |
| ***B26D 5/34*** | (2006.01) |
| *B26F 1/38* | (2006.01) |
| *B26D 5/32* | (2006.01) |

(52) U.S. Cl.

CPC ..... *B41J 11/706* (2013.01); *B41J 11/663* (2013.01); *B26F 1/3806* (2013.01); *B26D 1/045* (2013.01); *B26D 5/32* (2013.01); *B26D 5/34* (2013.01)

USPC ..... 347/104; 347/157; 101/224

(58) Field of Classification Search

USPC ..... 347/104, 157; 83/13, 34, 75, 365; 101/117, 224, 226; 700/134, 150, 167, 700/259; 400/621

See application file for complete search history.

(56) References Cited

U.S. PATENT DOCUMENTS

| | | | | |
|---|---|---|---|---|
| 6,672,187 | B2 * | 1/2004 | Alsten et al. | 83/13 |
| 7,055,418 | B2 * | 6/2006 | Maddalon | 83/72 |
| 7,249,903 | B2 * | 7/2007 | Shaw, III | 400/621 |
| 7,422,386 | B2 * | 9/2008 | Ohmori et al. | 400/621 |

FOREIGN PATENT DOCUMENTS

| | | |
|---|---|---|
| JP | 2005-297248 | 10/2005 |

* cited by examiner

*Primary Examiner* — Anh T.N. Vo
(74) *Attorney, Agent, or Firm* — Jianq Chyun IP Office

(57) ABSTRACT

A cutting device includes a guide rail opposing a platen, a printer head that prints an image and Trim marks on a sheet member, a cutter blade that performs a cutting process on the sheet member, a medium feeding mechanism that feeds the sheet member from front and back, a Trim mark detection portion that detects positions of the reference marks, and a controller that sets a cutting process position to correspond to a printing position of the image, prints the image and Trim marks while feeding the sheet member forward, detects the positions of the Trim marks with the Trim mark detection portion, and performs the cutting process with the cutter blade in the cutting process position set by the controller.

5 Claims, 8 Drawing Sheets

CUTTING DEVICE AND CUTTING METHOD THEREOF

CROSS-REFERENCE TO RELATED APPLICATION

This application is a 371 of international application of PCT application serial no. PCT/JP2010/003479, filed on May 25, 2010, which claims the priority benefit of Japan application no. 2009-201303, filed on Sep. 1, 2009. The entirety of each of the above-mentioned patent applications is hereby incorporated by reference herein and made a part of this specification

TECHNICAL FIELD

The present invention relates to a cutting device including a cutting head that performs a cutting process on a target medium, and to a cutting method using the cutting device.

BACKGROUND ART

To date, a device that performs a cutting process on a target medium by carrying out a combination of an operation moving a cutting head left to right and back again with respect to a target medium supported by a platen and an operation feeding the target medium front and back has been known as an example of the heretofore described kind of cutting device. Meanwhile, there is also known a printer device configured so as to print an image on a surface of a target medium, using a printer head that ejects ink from an ejection nozzle instead of the cutting head.

In recent years, however, there is a demand to, as well as print an image on a target medium, perform a cutting process corresponding with the printed image. In order to respond to this demand, a cutting device in which a cutting head and printer head are mounted has been developed, and it is possible to consecutively carry out a printing and a cutting process using the cutting device. For example, a configuration wherein a carriage 2 on which an inkjet head 26 is mounted and a carriage 24 on which a cutting head 28 is mounted are movable along a guide rail 18 is disclosed in FIG. 1 of Patent Document 1. With this configuration, it is possible to perform a printing and a cutting process on a sheet 100 mounted on a base member 12.

With the heretofore described cutting device, firstly, an image and, for example, four reference marks (hereafter called Trim marks) surrounding the image are printed using the printer head. Then, when carrying out a cutting process using the cutting head, it is possible to ascertain a printing position of the image with respect to the Trim marks by detecting the positions of the Trim marks, and it is thus possible to perform the cutting process in a position corresponding to the image. When performing a printing and a cutting process on a sheet-like target medium, for example, the printing is performed over the whole of a printing region of the target medium while feeding the target medium forward, and the target medium is rolled up into a roll form.

After the printing is finished, and before starting the cutting process, the target medium rolled into a roll form is back-fed in a backward direction, and a portion of the target medium printed first (a print starting position) is positioned on the platen. Then, the position of a first reference mark, of the four reference marks corresponding to an image printed on a front end of the target medium, is detected using a Trim mark detection portion, the target medium is fed from front to back and the position of a second reference mark detected, the Trim mark detection portion is moved left to right and a third reference mark detected, and the target medium is fed from front to back again, and the position of a fourth reference mark detected.

RELATED ART DOCUMENTS

Patent Documents

Patent Document 1: JP-A-2005-297248

DISCLOSURE OF INVENTION

Problem to be Solved by the Invention

However, when using the heretofore described cutting device, it is necessary to feed the target medium from front to back twice when detecting the positions of the reference marks corresponding to one image. Taking into account the heretofore described back-feed, it is necessary to feed the target medium from front to back three times before starting the cutting process. Because of this, for example, when printing an image that is long from front to back (for example, the front-back length is approximately 1 m), and performing a cutting process along the outline of the image, it is necessary to feed the target medium a considerable distance (approximately 1 m) twice from front to back when detecting the positions of the reference marks. When the target medium is fed a considerable distance from front to back in this way, misalignment is liable to occur due to the target medium being fed in a condition in which it is at a slight tilt with respect to the front-back direction, because of which, a problem occurs in that it is difficult to ensure positional accuracy of the cutting head and target medium.

Also, for example, when printing plural images that are short from front to back aligned from front to back, misalignment is not liable to occur when detecting the positions of the reference marks, however, because the target medium is fed backward by being back-fed once before starting the cutting process, there is a problem in that misalignment is liable to occur at that time.

The invention, having been contrived bearing in mind the heretofore described problems, has an object of providing a cutting device, and a cutting method thereof, with which a cutting process is possible in a condition wherein positional accuracy of a cutting head and target medium is ensured.

Means for Solving the Problems

In order to achieve this kind of object, a cutting device according to the invention includes a guide rail provided extending in a scanning direction opposing medium support means (for example, a platen 30 in the embodiment) that supports a target medium (for example, a sheet member 8 in an embodiment), a printer head, provided so as to be movable along the guide rail, that prints an image and reference marks (for example, Trim marks T1, T2, T3, and T4 in the embodiment) on the periphery of the image, by ejecting ink toward the target medium supported by the medium support means, a cutting head (for example, a cutter blade 53 in the embodiment), provided so as to be movable along the guide rail, that performs a cutting process on the target medium supported by the medium support means, a medium feeding mechanism that feeds the target medium in a conveying direction perpendicular to the scanning direction, a mark position detection portion (for example, a Trim mark detection portion 54 in the embodiment), provided so as to be movable along the guide rail, that detects positions of the reference marks, and a cutting position setting portion (for example, a controller 9 in the embodiment) that, based on the positions of the reference marks obtained by the mark position detection portion, detects a printing position of the image with respect to the reference marks, and sets a cutting process position to correspond with the printing position of the image, the cutting device being configured so as to print the image and reference marks while feeding the target medium to one side in the conveying direction with the medium feeding mechanism, and perform a cutting process in a cutting process position set by the cutting position setting portion, wherein the positions of the reference marks printed on the periphery of an other side image (for example, an image N1 in the embodiment), of the plural images, printed farthest to the other side in the conveying direction are detected before starting a cutting process, and a cutting process is performed for the other side image.

With the heretofore described cutting device, it is preferable that at least three of the reference marks are printed on the periphery of the image by the printer head, and the positions of at least three reference marks printed on the periphery of the other side image are detected by the mark position detection portion before starting a cutting process.

Also, with the heretofore described cutting device, it is preferable that, before starting a cutting process for the image, the printing position of the image is detected by detecting the position of a first reference mark (for example, the Trim mark T1 in the embodiment), of the reference marks printed on the periphery of the image, positioned nearest to the mark position detection portion with the mark position detection portion, moving the mark position detection portion in the scanning direction and detecting the position of a second reference mark (for example, the Trim mark T2 in the embodiment) printed and positioned in the scanning direction with respect to the first reference mark, and feeding the target medium in the conveying direction with the medium feeding mechanism and detecting the position of a third reference mark (for example, the Trim mark T3 in the embodiment) printed and positioned in the conveying direction with respect to the second reference mark.

A cutting method according to the invention is a cutting method of a cutting device that prints an image and reference marks in a periphery of the image, while feeding a target medium to one side in a conveying direction, detects a printing position of the image with respect to the reference marks based on the positions of the reference marks, sets a position in which to perform a cutting process with a cutting head, and performs a cutting process, and the method includes a first step of detecting the positions of the reference marks printed on the periphery of an other side image, of the plural images, printed farthest to the other side in the conveying direction before starting a cutting process, and a second step of performing a cutting process for the other side image.

Advantages of the Invention

The cutting device according to the invention is configured so as to, after printing the image and reference marks while feeding the target medium to one side in the conveying direction, and before starting the cutting process, detect the positions of the reference marks printed on the periphery of the other side image printed farthest to the other side in the conveying direction, and perform the cutting process for the other side image. In this way, by adopting a configuration wherein the cutting process is performed while carrying out a back-feed returning the target medium to the print starting position after the printing is completed, it is possible to reduce the number of times (frequency) the target medium is fed from front to back when performing the cutting process. Because of this, it becomes less common that the target medium is conveyed tilted, it is possible to reduce misalignments caused by the target medium being conveyed tilted, and it is thus possible to ensure the positional accuracy of the cutting head and target medium.

With the heretofore described cutting device, a configuration wherein at least three of the reference marks are printed on the periphery of the image by the printer head, and a cutting process position is set based on the positions thereof, is preferable. In this way, by setting the cutting process position based on the positions of the plural reference marks, it is possible to carry out a distance correction in the conveying direction and scanning direction, as well as a tilt correction. Because of this, even in a case in which, for example, the target medium expands or contracts after printing, it is possible to perform a cutting process corresponding to the image with high positional accuracy.

Also, a configuration wherein the printing position of the image is detected by detecting the position of the first reference mark, of the plural reference marks, positioned nearest to the mark position detection portion, moving the mark position detection portion in the scanning direction and detecting the position of the second reference mark, and feeding the target medium in the conveying direction with the medium feeding mechanism and detecting the position of the third reference mark, is preferable. When configuring in this way, it is possible to detect the positions of the three reference marks, and detect the position of the image with respect to the reference marks, by moving the target medium once only in the conveying direction. With the heretofore known configuration, it is necessary to feed the target medium in the conveying direction twice in order to detect the position of the image, but with the cutting device according to the invention, it is possible to detect the position of the image by feeding only once. Because of this, it is possible to reduce the occurrence of misalignments of the target medium by reducing the frequency with which the target medium is fed in the conveying direction, and thus possible to ensure the positional accuracy of the cutting head and target medium.

The cutting method according to the invention includes a first step of detecting the positions of the reference marks printed on the periphery of the other side image, of the plural images, before starting the cutting process, and a second step of performing the cutting process for the other side image. According to the configuration, it is possible to detect the printing position of the image with respect to the reference marks by feeding the target medium only once in the conveying direction. Because of this, it is possible to ensure the positional accuracy of the cutting head and target medium by reducing the frequency with which the target medium is fed in the conveying direction, thus reducing the occurrence of misalignments of the target medium.

BEST MODE(S) FOR CARRYING OUT THE INVENTION

Figure 1:
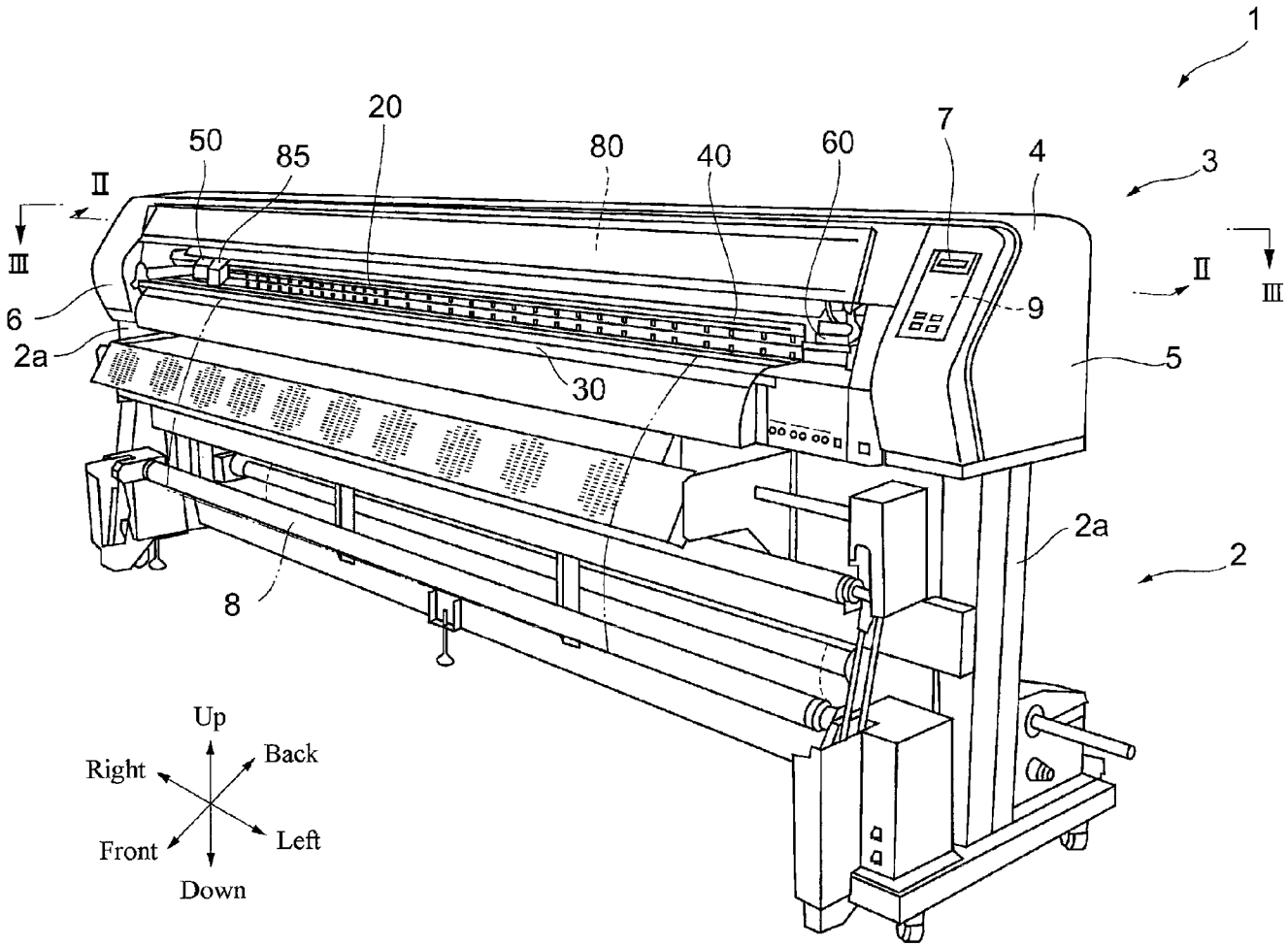
FIG. 1 is a perspective view of a cutting device according to the invention.

Hereafter, referring to the drawings, a description will be given of an embodiment of the invention. Hereafter, for the sake of convenience, the description will be given with arrow directions shown in each drawing defined as front-back, left-right, and up-down.

A description will be given, while referring to FIGS. 1 to 5, of a configuration of a cutting device 1 to which the invention is applied. FIG. 1 shows a perspective view of the cutting device 1, FIG. 2 an internal configuration of a main body portion 3, to be described hereafter, FIG. 3 a plan view of a unit drive device 80, to be described hereafter, FIG. 4 a perspective view of the periphery of a printing unit 60, to be described hereafter, and FIG. 5 a control system diagram of a cutting device 1 respectively.

The cutting device 1, as shown in FIG. 1, is mainly configured of a support portion 2 formed of a left-right pair of support legs 2*a*, 2*a*, and the main body portion 3 extending left to right supported by the support portion 2. A left main body portion 5 and a right main body portion 6 are formed respectively in left and right end portions of the main body portion 3, and external periphery portions thereof are covered by a main body cover 4. An operation portion 7 formed of operation switches, display devices, and the like, is provided on a front surface side of the left main body portion 5. A controller 9 into which an operation signal from the operation portion 7 is input is provided inside the left main body portion 5.

Figure 5:
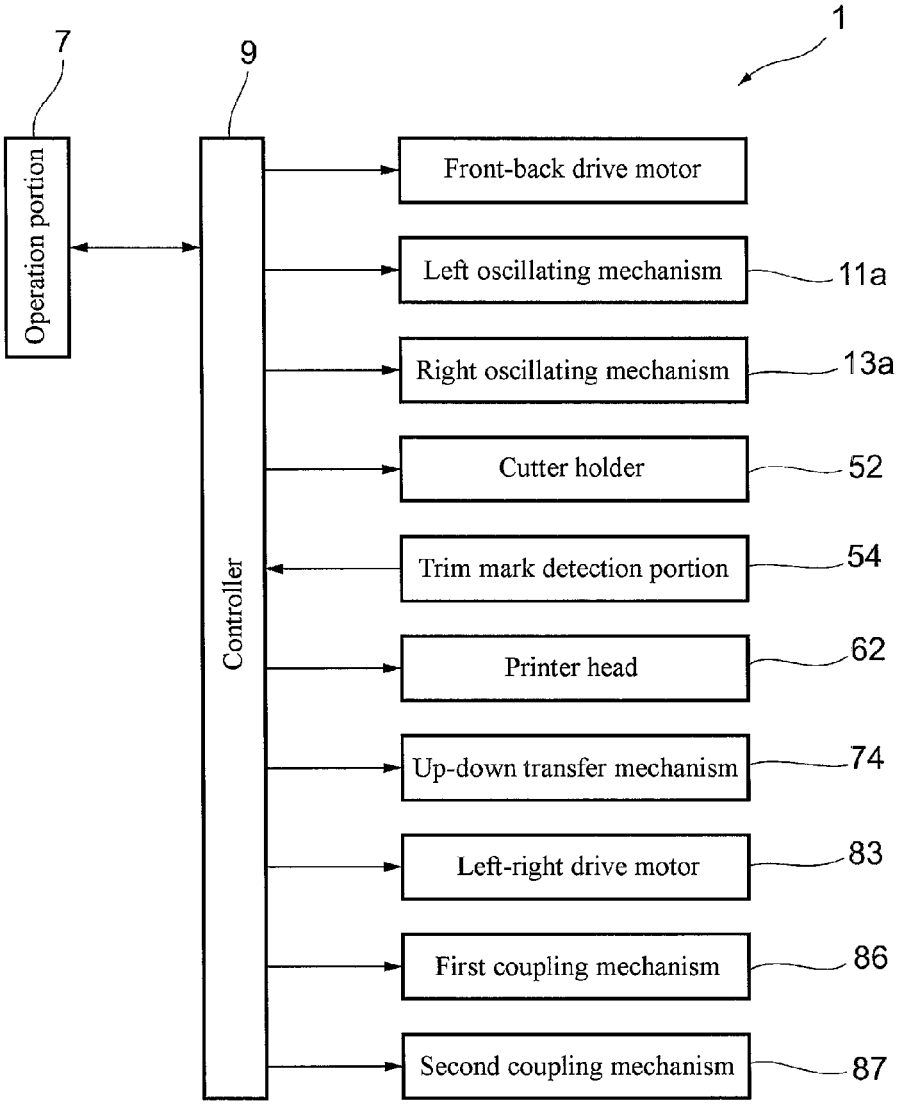
FIG. 5 is a control system diagram of the cutting device 1.

The controller 9 is electrically connected to each component, to be described hereafter, and carries out an operation control by outputting an operation signal to each component. Specifically, as shown in FIG. 5, the controller 9 controls a drive of a front-back drive motor, a drive of a left oscillating mechanism 11*a*, a drive of a right oscillating mechanism 13*a*, an up-down movement of a cutter holder 52, an ejection of ink from a printer head 62 (ejection nozzle), a drive of an up-down transfer mechanism 74, a drive of a left-right drive motor 83, a coupling by a first coupling mechanism 86, and a coupling by a second coupling mechanism 87, to be described hereafter. Also, a result of receiving an inspection light in a Trim mark detection portion 54, to be described hereafter, is input into the controller 9.

A medium feeding mechanism 20, a plate-like platen 30 that supports a sheet member 8, which is a target of a print and cutting process, a guide member 40 provided extending left to right above the platen 30, a cutting unit 50, a printing unit 60, a maintenance device 70, the unit drive device 80, and the like, are disposed between the left main body portion 5 and right main body portion 6.

Figure 4:
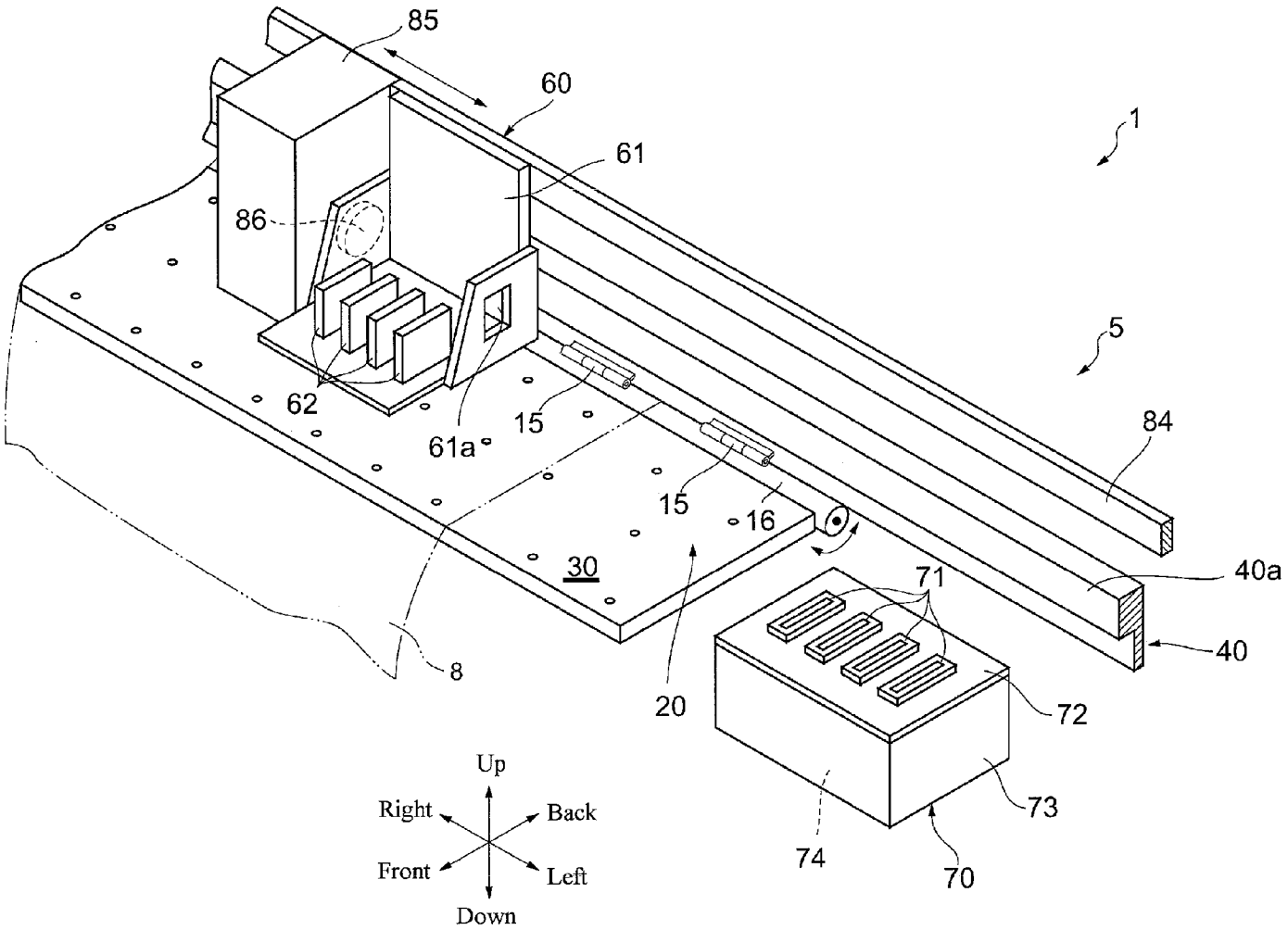
FIG. 4 is a perspective view showing the vicinity of the guide member of the cutting device.

The medium feeding mechanism 20, as shown in FIG. 4, is mainly configured of a rotatable plural pinch rollers 15 disposed so as to be aligned left to right in a lower portion of the guide member 40, and a feeding roller 16 provided so as to be exposed in the platen 30 under the pinch rollers 15. The feeding roller 16 is rotated by an unshown front-back drive motor. With this configuration, in a condition in which the sheet member 8 is sandwiched between the feeding roller 16 and pinch rollers 15, it is possible to feed the sheet member 8 a predetermined distance frontward and backward by rotating the feeding roller 16 with the front-back drive motor.

Figure 2:
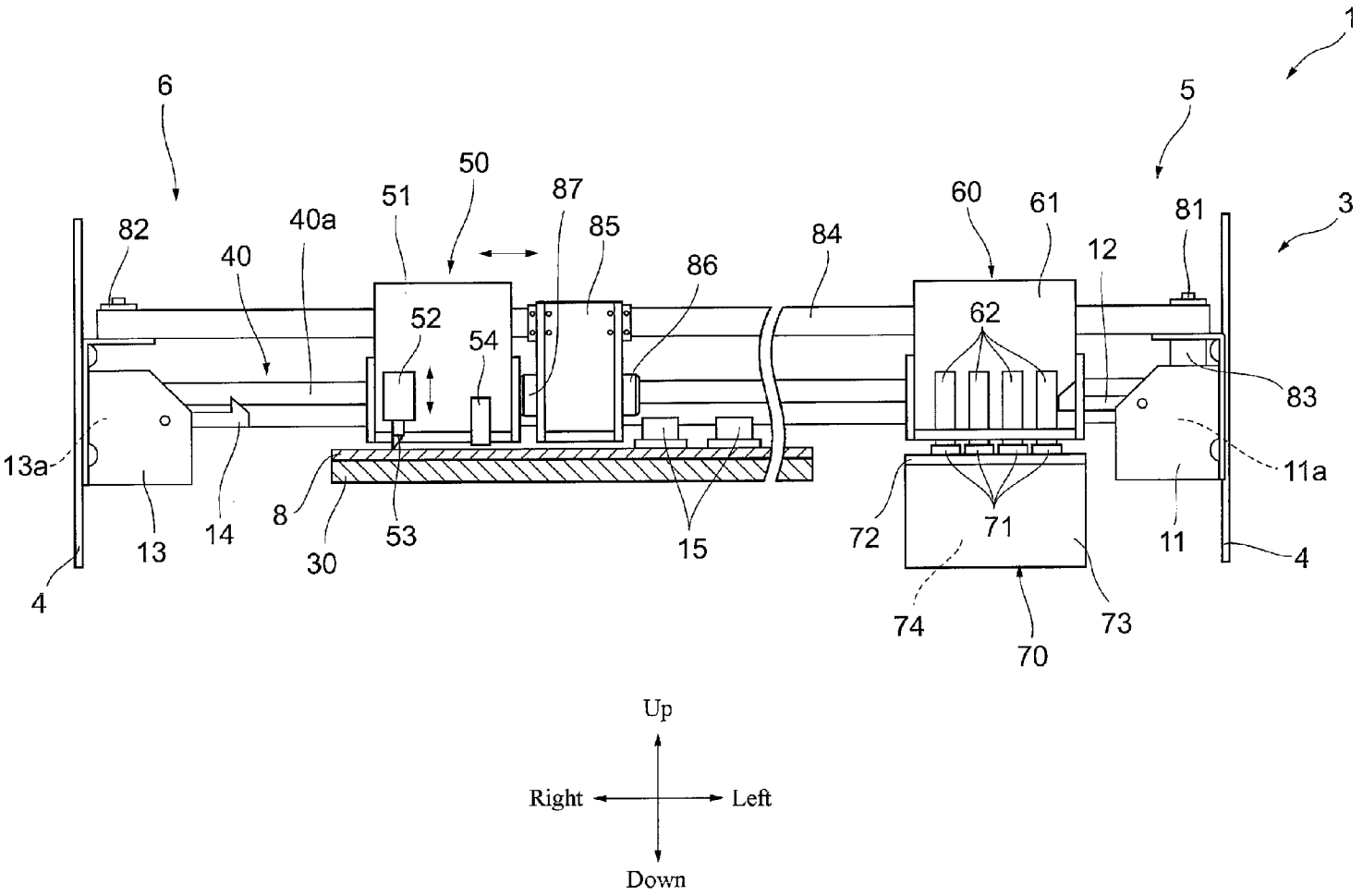
FIG. 2 is a front view showing a vicinity of a guide member of the cutting device.

The cutting unit 50, as shown in FIG. 2, is mainly configured of a cutting carriage 51, the cutter holder 52, and the Trim mark detection portion 54. The cutting carriage 51 is attached so as to be movable left and right to a guide rail 40*a* formed on a front surface side of the guide member 40, and forms an attachment base of the cutter holder 52 and Trim mark detection portion 54. Also, an engagement portion (not shown) engageable with a right hook 14, to be described hereafter, is formed on a right surface of the cutting carriage 51.

The cutter holder 52 is mounted so as to be movable up and down to the cutting carriage 51, and a cutter blade 53 is removably attached to a lower end portion of the cutter holder 52. The Trim mark detection portion 54 includes a light emitting portion (not shown) and a light receiving portion (not shown) on a lower surface thereof. A configuration is such that reflected light of an inspection light projected in a downward direction from the light emitting portion is received by the light receiving portion. For example, light receiving sensitivity of the light receiving portion is set in such a way that, while an inspection light (an inspection light with a high intensity) is reflected from a surface of the sheet member 8 on which no printing has been carried out, and received by the light receiving portion, the inspection light is not reflected (an inspection light with a low intensity is reflected) from portions in which Trim marks T1 to T4, to be described hereafter, are printed.

The printing unit 60 is mainly configured of a printing carriage 61 and plural printer heads 62. The printing carriage 61, in the same way as the cutting carriage 51, is attached so as to be movable left and right to the guide rail 40*a*, and forms an attachment base of the printer heads 62. Also, an engagement portion 61*a* engageable with a left hook 12, to be described hereafter, is formed on a left surface of the printing carriage 61 (refer to FIG. 4). The plural printer heads 62 are configured of various colors, for example, magenta, yellow, cyan, and black. Also, plural ejection nozzles (not shown) from which ink is ejected in a downward direction are formed on a lower surface of each printer head 62.

As shown in FIG. 2 and FIG. 4, the maintenance device 70 is provided inside the left main body portion 5. The maintenance device 70 is mainly configured of (four) suction caps 71 formed following the form of lower surfaces of the printer heads 62, a stage 72 on which the suction caps 71 are mounted, a device main body 73, and the up-down transfer mechanism 74 provided inside the device main body 73. With this configuration, in a condition in which the printer heads 62 and suction caps 71 are caused to oppose each other up and down, it is possible to cover the lower surfaces of the printer heads 62 with the suction caps 71 by moving the stage 72 upward with the up-down transfer mechanism 74. In this way, it is possible to prevent drying (thickening) of the ink in the ejection nozzles by covering the lower surfaces of the printer heads 62.

Figure 3:
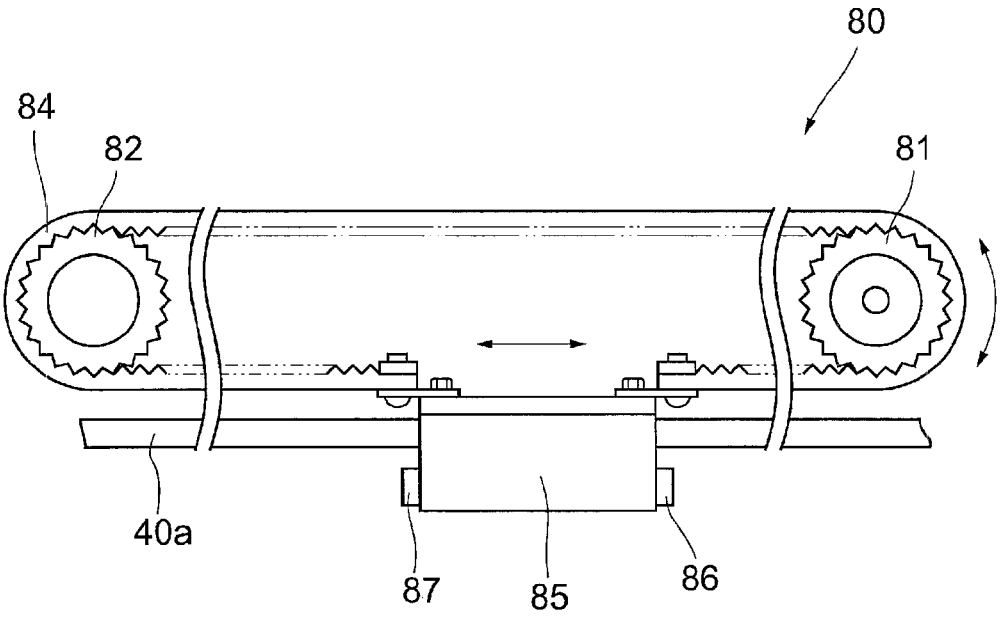
FIG. 3 is a plan view of a unit drive device.
Figure 3:
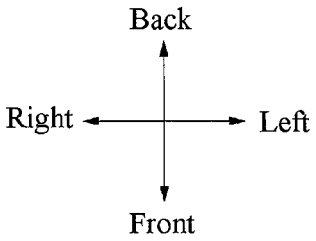

The unit drive device 80, as shown in FIG. 2 and FIG. 3, is mainly configured of a drive pulley 81 and idler pulley 82 provided positioned in left and right end portions of the guide member 40, a left-right drive motor 83 that rotationally drives the drive pulley 81, a belt-like toothed drive belt 84 suspended between the two pulleys 81 and 82, and a drive carriage 85 coupled to the toothed drive belt 84. The first coupling mechanism 86, which detachably couples the printing carriage 61 and drive carriage 85, is formed on a left surface side of the drive carriage 85. Meanwhile, the second coupling mechanism 87, which is configured in the same way as the first coupling mechanism 86 and detachably couples the cutting carriage 51 and drive carriage 85, is formed on a right surface side of the drive carriage 85. It is possible to use, for example, a configuration such that coupling is performed by engaging an engagement protrusion in an engagement hole, a configuration such that coupling is performed utilizing magnetism, or the like, as the first coupling mechanism 86 and second coupling mechanism 87.

With this configuration, by a drive control of the left-right drive motor 83, first coupling mechanism 86, and second coupling mechanism 87 being carried out by the controller 9, it is possible to carry out a control moving the cutting unit 50 or printing unit 60, in a condition in which it is coupled to the drive carriage 85, left and right along the guide rail 40*a*.

As shown in FIG. 2, a left hook support portion 11 incorporating the left oscillating mechanism 11*a* is fixedly installed inside the left main body portion 5. By causing the left hook 12 to oscillate up and down with the left oscillating mechanism 11*a*, it is possible to cause the engagement portion 61*a* of the printing carriage 61 and the left hook 12 to engage, or to cause a disengagement. Meanwhile, a right hook support portion 13 incorporating the right oscillating mechanism 13*a* is fixedly installed inside the right main body portion 6. In the same way as with the left hook support portion 11, by causing the right hook 14 to oscillate up and down with the right oscillating mechanism 13*a*, it is possible to cause the engagement portion of the cutting carriage 51 and the right hook 14 to engage, or to cause a disengagement.

Figure 6:
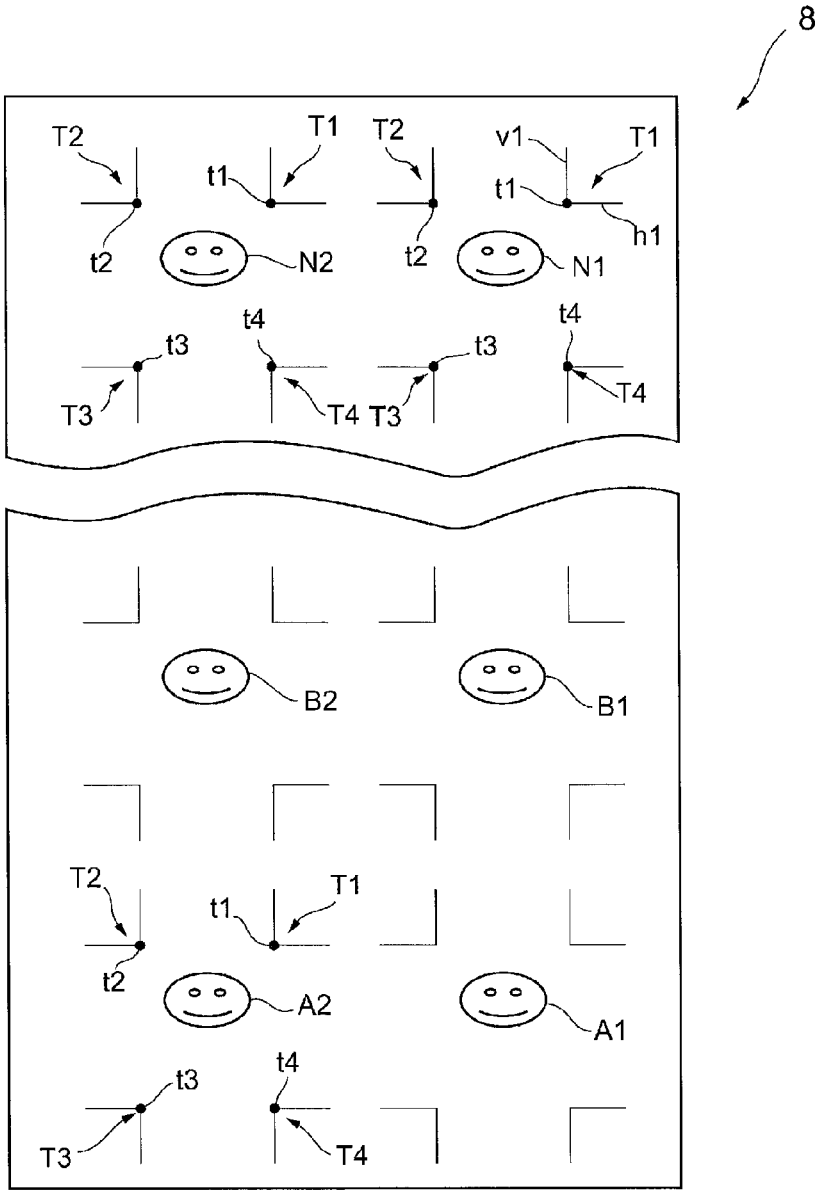
FIG. 6 is a plan view of a sheet member on which printing has been performed.
Figure 6:
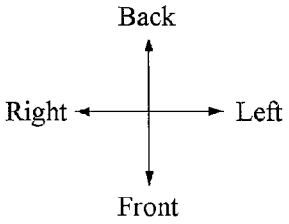

Thus far, a description has been given of the configuration of the cutting device 1. Hereafter, a description will be given, with additional reference to FIG. 6 and FIG. 7, of an operation of each component when, after first performing a printing over the whole of a printing region while feeding the elongated sheet member 8 forward, using the cutting device 1 configured as heretofore described, cutting the sheet member 8 without removing it from the cutting device 1. FIG. 6 shows a plan view of the sheet member 8 on which printing has been performed, and FIG. 7 a flowchart of the cutting device 1.

In the following description, an example is given of a case wherein four Trim marks T1 to T4 are printed together with an image A1, and the like, it is wished to obtain, in such a way as to surround each image, as shown in FIG. 6, and a cutting process is performed along the outline of the image A1, and the like. Also, as described hereafter, the cutting device 1, apart from consecutively carrying out a printing and a cutting process, can also, for example, perform only a printing or perform only a cutting process on the sheet member 8.

Before the start of printing (in a waiting condition), it is assumed that the drive carriage 85 is coupled to neither the cutting unit 50 nor the printing unit 60. In this condition, the engagement portion of the cutting carriage 51 and the right hook 14 are engaged, and the cutting unit 50 is held at the right end of the guide rail 40*a*, while the engagement portion 61*a* of the printing carriage 61 and the left hook 12 are engaged, and the printing unit 60 is held at the left end of the guide rail 40*a*. Also, the lower surfaces of the printer heads 62 are covered by the suction caps 71.

Figure 7:
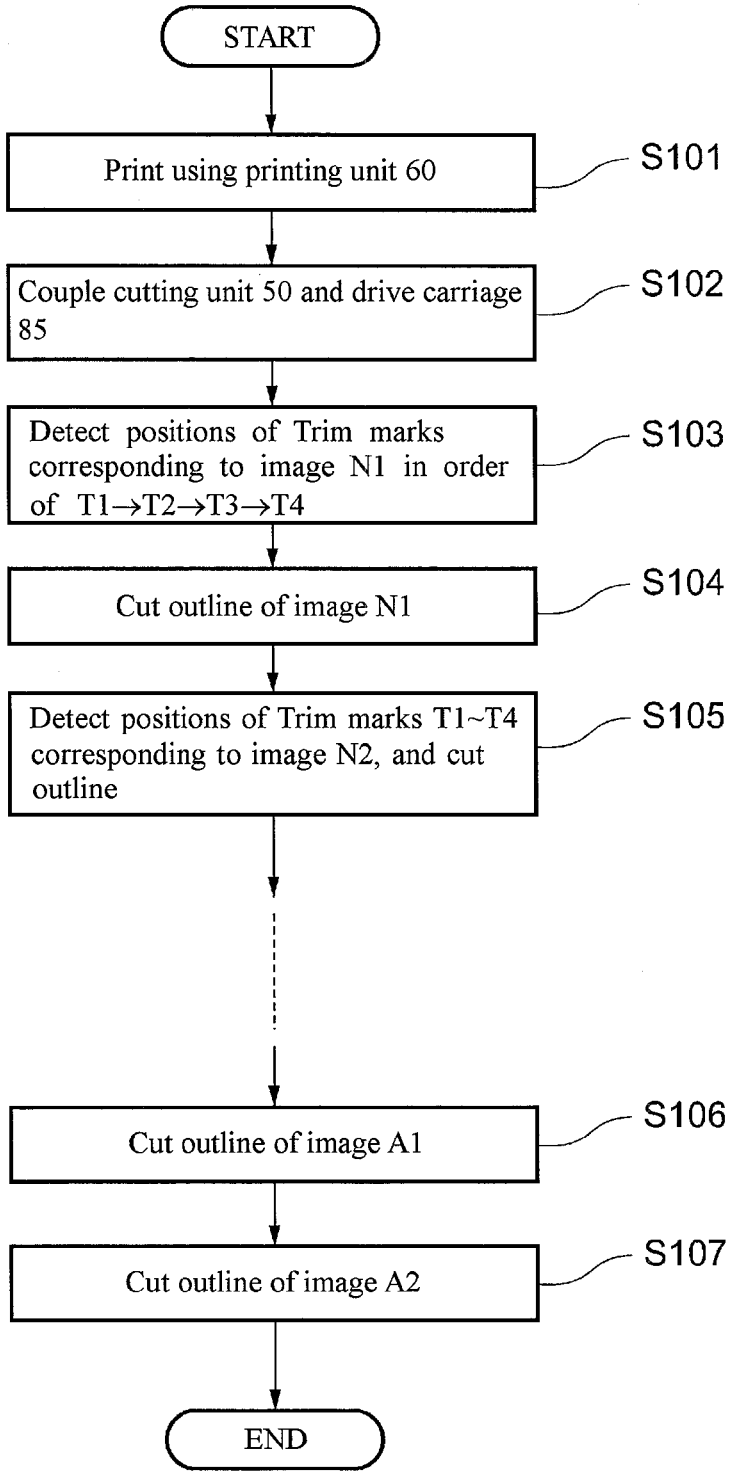
FIG. 7 is a flowchart of the cutting device.

Firstly, in step S101 shown in FIG. 7, on printing being started by an operator operating the operation portion 7, the drive carriage 85 is moved to the left based on an operation signal from the controller 9, and the drive carriage 85 and printing carriage 61 are coupled by the first coupling mechanism 86. Then, the engagement portion 61*a* and left hook 12 are disengaged along with the suction caps 71 being moved downward, and the printing unit 60 is in a condition wherein it is movable along the guide rail 40*a*.

In this condition, printing is performed over the whole of the printing region of the sheet member 8 by carrying out a combination of a control causing ink to be ejected in a downward direction from the printer heads 62 while moving the printing unit 60 left to right and back again and a control feeding the sheet member 8 forward with the front-back drive motor. An example of the sheet member 8 on which printing has been performed in this way is shown in FIG. 6, wherein printing is performed on the sheet member 8 sequentially from a forward side. As can be understood from FIG. 6, along with plural images A1, A2, B1, B2, . . . , N1, N2, the L-shaped Trim marks T1 to T4 printed so as to surround each image are printed four to each image. Also, the Trim mark T1 is printed on a left back side, the T2 on a right back side, the T3 on a right front side, and the T4 on a left front side respectively with respect to each image.

Proceeding to step S102 on the heretofore described printing being completed, the printing unit 60 is moved to the left and held at the left end of the guide rail 40*a*, and the coupling of the drive carriage 85 and printing carriage 61 by the first coupling mechanism 86 is broken. Then, the drive carriage 85 is moved to the right and, after the drive carriage 85 and cutting carriage 51 are coupled by the second coupling mechanism 87, the engagement portion of the cutting carriage 51 and right hook 14 are disengaged, and the cutting unit 50 is in a condition wherein it is movable along the guide rail 40*a*.

Next, proceeding to step S103, the positions of the Trim marks T1 to T4 corresponding to the image N1 are detected. At this time, the sheet member 8 is still in the same front-back position as at the completion of the printing, that is, the vicinity of the portions on which the images N1 and N2 are printed is mounted on the platen 30. For this reason, simply by moving the cutting unit 50 coupled to the drive carriage 85 to the left, it is automatically possible to position the Trim mark detection portion 54 above the Trim mark T1 printed corresponding to the image N1, and it is thus possible to sequentially detect the Trim mark positions, as will be described hereafter. Therefore, there being no need to newly set a position of starting a cutting process, it is possible to automatically set the cutting process starting position, meaning that it is possible to configure the control configuration simply.

By moving the sheet member 8 from front to back in a condition in which the cutting unit 50 is held in this position, a left-right line h1 of the Trim mark T1 passes below the Trim mark detection portion 54. As the inspection light is not reflected from the portions in which the Trim marks T1 to T4 are printed, as heretofore described, it is possible to detect a front-back position of the left-right line h1 from a result of received inspection light in the light receiving portion. By moving the cutting unit 50 from left to right after detecting the front-back position of the left-right line h1, in a condition in which the front-back position of the sheet member 8 is fixed, a front-back line v1 of the Trim mark T1 passes below the Trim mark detection portion 54, and it is possible to detect a left-right position of the front-back line v1.

From the front-back position and left-right position detected as heretofore described, it is possible to compute a first reference position t1 at which the left-right line h1 and front-back line v1 intersect. After computing the first reference position t1, the cutting unit 50 is moved to the right, and positioned in the vicinity of the Trim mark T2. Then, in the same way as in the case of the Trim mark T1, a second reference position t2 at which a left-right line and front-back line of the Trim mark T2 intersect is computed. Then, the sheet member 8 is fed backward, and a third reference position t3 of the Trim mark T3 computed, and continuing, the cutting unit 50 is moved to the left, and a fourth reference position t4 of the Trim mark T4 computed.

Based on the computed first reference position t1 to fourth reference position t4, the printing position of the image N1 with respect to the first reference position t1 to fourth reference position t4 is computed in the controller 9. Then, cutting position data, indicating in what position on the sheet member 8 a cutting process is to be performed, are set. A configuration may also be such that the cutting position data are set in advance based on printing position data used when printing, and the cutting position data are corrected and set in accordance with the computed printing position of the image N1. When configuring in this way, even in a case in which the form of the image N1 becomes slightly distorted in comparison with immediately after printing due to the drying of the ink, it is possible to perform a cutting process in a position corresponding to the form after the distortion. For example, even in the event that a back portion of the image N1 is distorted in such a way as to spread out with respect to a front portion (is distorted into a trapezoid form), a trapezoidal correction adjusting the cutting position to the image N1 is possible.

In step S104, based on the set cutting position data, a cutting process is performed along the outline of the image N1 by causing the cutter blade 53 to cut into the sheet member 8 while moving the cutting unit 50 from left and right and feeding the sheet member 8 frontward and backward.

In this way, the cutting device 1 according to the invention is of a configuration such as to carry out a cutting process from the image N1 printed on the back end after printing is completed, without carrying out a large back-feed of the sheet member 8 in a backward direction, as has been done to date. Therefore, by reducing the amount of feed of the sheet member 8 in the front-back direction, and the frequency with which the sheet member 8 is fed, misalignment of the sheet member 8 liable to occur when feeding is reduced, and it is possible to ensure positional accuracy of the sheet member 8 and cutter blade 53. Also, to date, it has happened that a large misalignment occurs when back-feeding in a backward direction, due to which a detection error occurs wherein the Trim marks are not positioned below the Trim mark detection portion 54 and the Trim marks cannot be detected, and the series of operations is interrupted. Meanwhile, with the cutting device 1 according to the invention, it is possible to reduce the occurrence of misalignments as heretofore described, meaning that it is possible to efficiently execute the series of operations without causing this kind of detection error.

However, for example, when carrying out a printing extending over, for example, several tens of meters in the front-back direction at one time, it has been necessary with a heretofore known method to back-feed the sheet member 8 for several tens of meters before starting a cutting process, and a commensurate amount of extra working time has been needed. Meanwhile, with the cutting device 1 according to the invention, as the configuration is such that cutting is carried out sequentially from an image printed on the back end (last), it is possible to shorten the working time needed for the heretofore described back-feed, and it is thus possible to shorten the time needed for the series of operations of the printing and cutting process, thereby improving work efficiency.

Next, proceeding to step S105, the cutting unit 50 is moved to the right after the cutting process for the image N1 is completed and, in the same way as for the image N1, the first reference position t1 to fourth reference position t4 of the Trim marks T1 to T4 corresponding to the image N2 are computed. The cutting position data are set based on the computed first reference position t1 to fourth reference position t4, and a cutting process is performed along the outline of the image N2.

After the cutting of the image N2 is completed, the cutting unit 50 is moved to the left and the sheet member 8 fed backward, and the same kind of cutting process is performed for an image (not shown) adjacent in a forward direction to the image N1. In this way, cutting is carried out sequentially from an image printed on the back end. Then, in step S106, cutting is carried out for the image A1 printed on a front end portion, after which, proceeding to step S107, the flow finishes by a cutting being performed for the image A2 printed to the right of the image A1. According to the heretofore described flow, images are printed, and it is possible to obtain plural resulting articles cut into the outline forms of the images.

Figure 8:
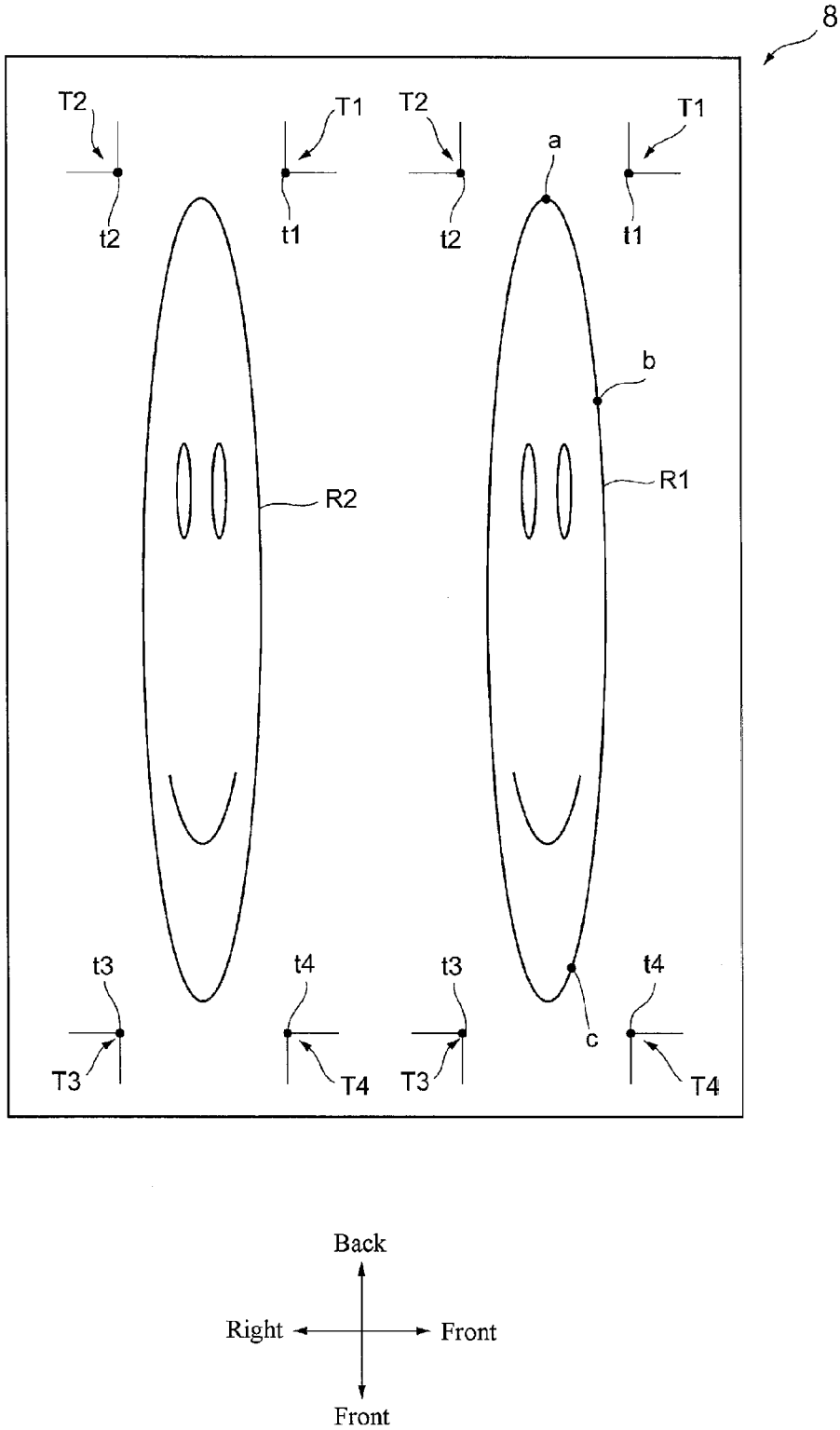
FIG. 8 is a plan view of the sheet member on which a printing differing from that in FIG. 6 has been performed.

FIG. 8 shows a plan view of the sheet member 8 on which are printed, aligned from left to right, images R1 and R2 of a form differing from that in FIG. 6. As can be understood from FIG. 8, the images R1 and R2 are of a form longer from front to back than the image A1 and the like. Hereafter, a description will be given of an operation of the cutting device 1 when carrying out a cutting process on the sheet member 8 on which the kinds of image R1 and R2 of FIG. 8 are printed using the printer heads 62.

In this case too, printing is performed from the front to the back, and when the printing is completed, the vicinity of the Trim marks T1 and T2 is positioned on the platen 30. Then, in the same way as heretofore described, the first reference position t1, second reference position t2, third reference position t3, and fourth reference position t4 of the Trim mark T1~T4 corresponding to the image R1 are detected, in that order, and a cutting process is performed for the image R1. After the cutting process for the image R1 is completed, the positions of the Trim marks T1 to T4 corresponding to the image R2 are detected, and a cutting process is performed for the image R2.

Herein, when the position of the cutting unit 50 when the cutting process for the image R1 is finished is, for example, a completion position a or a completion position b, the first reference position t1 of the Trim mark T1 corresponding to the image R2 nearest to the completion positions is detected first. Continuing, the second reference position t2, third reference position t3, and fourth reference position t4 are detected, in that order, and a cutting process is performed for the image R2. Meanwhile, when the cutting process finishes in, for example, a completion position c, the fourth reference position t4 of the Trim mark T4 corresponding to the image R2 nearest to the completion position c is detected first. Subsequently, the third reference position t3, second reference position t2, and first reference position t1 are detected, in that order, and a cutting process is performed for the image R2.

In this way, in accordance with the completion position in which the cutting process finishes, position detection is carried out sequentially from the Trim mark, of the plural Trim marks corresponding to the adjacent image, in the position nearest to the completion position (a position such that a small amount of front-back feed of the sheet member 8 is sufficient) . By so doing, it is possible to reduce the amount of feed of the sheet member 8 in the front-back direction, and it is thus possible to reduce misalignment of the sheet member 8, thereby maintaining the positional accuracy of the sheet member 8 and cutter blade 53.

In the heretofore described embodiment, an example is given of a case wherein the invention is applied to the cutting device 1 which, including the printer heads 62, can also perform a printing but, for example, the invention may also be applied to a cutting device which, not including the printer heads 62, can perform only a cutting process.

In the heretofore described embodiment, a description is given with a configuration wherein the four L-shaped Trim marks T1 to T4 are printed for one image as an example, but the invention is not limited to this configuration. For example, a configuration may be such that three Trim marks are printed for one image, and also, the shape of the Trim marks is not limited to the L-shape.

In the heretofore described embodiment, a description is given of a configuration wherein the four Trim marks T1 to T4 are printed for one image, and the printing position of the image is computed by detecting the positions of the Trim marks T1 to T4, but the invention is not limited to this configuration. For example, it is also possible to adopt a configuration wherein the position of a detected optional first Trim mark, of the four Trim marks T1 to T4, is set as an origin. Also, it is also possible to adopt a method whereby a second Trim mark printed and positioned in a left-right direction from the detected first Trim mark is detected, and a left-right direction correction and a tilt correction are carried out, or a method whereby a second Trim mark printed and positioned in a front-back direction from the detected first Trim mark is detected, and a front-back direction correction and a tilt correction are carried out. Furthermore, it is also possible to adopt a method whereby, by detecting a second Trim mark printed and positioned diagonally with respect to the detected first Trim mark, or detecting first to third Trim marks, a left-right direction correction, a front-back direction correction, and a tilt correction are carried out.

The invention claimed is:

1. A cutting device comprising:

a guide rail provided extending in a scanning direction opposing medium support means that supports a target medium;

a printer head, provided so as to be movable along the guide rail, that prints an image and reference marks on the periphery of the image, by ejecting ink toward the target medium supported by the medium support means;

a cutting head, provided so as to be movable along the guide rail, that performs a cutting process on the target medium supported by the medium support means;

a medium feeding mechanism that feeds the target medium in a conveying direction perpendicular to the scanning direction for printing and back-feeds the target medium in a backward direction after the completion of a printing process such that the cutting process is performed while back-feeding, the backward direction is parallel to the conveying direction;

a mark position detection portion, provided so as to be movable along the guide rail, that detects positions of the reference marks; and a cutting position setting portion that, based on the positions of the reference marks obtained by the mark position detection portion, detects a printing position of the image with respect to the reference marks, and sets a cutting process position to correspond with the printing position of the image, that prints the image and reference marks while feeding the target medium to one side in the conveying direction with the medium feeding mechanism, and performs the cutting process in the cutting process position set by the cutting position setting portion, the cutting device being characterized in that the positions of the reference marks printed on the periphery of an other side image, of the plural images, printed farthest to the other side in the conveying direction are detected before starting the cutting process, and the cutting process is performed for the other side image.

2. The cutting device according to claim 1, characterized in that at least three of the reference marks are printed on the periphery of the image by the printer head, and the positions of at least three reference marks printed on the periphery of the other side image are detected by the mark position detection portion before starting a cutting process.

3. The cutting device according to claim 2, characterized in that, before starting a cutting process for the image, the printing position of the image is detected by detecting the position of a first reference mark, of the reference marks printed on the periphery of the image, positioned nearest to the mark position detection portion with the mark position detection portion, moving the mark position detection portion in the scanning direction and detecting the position of a second reference mark printed and positioned in the scanning direction with respect to the first reference mark, and back-feeding the target medium in the backward direction with the medium feeding mechanism and detecting the position of a third reference mark printed and positioned in the backward direction with respect to the second reference mark.

4. The cutting device according to claim 1, characterized in that, before starting a cutting process for the image, the printing position of the image is detected by detecting the position of a first reference mark, of the reference marks printed on the periphery of the image, positioned nearest to the mark position detection portion with the mark position detection portion, moving the mark position detection portion in the scanning direction and detecting the position of a second reference mark printed and positioned in the scanning direction with respect to the first reference mark, and back-feeding the target medium in the backward direction with the medium feeding mechanism and detecting the position of a third reference mark printed and positioned in the backward direction with respect to the second reference mark.

5. A cutting method of a cutting device that prints an image and reference marks in a periphery of the image, while back-feeding a target medium to one side in a backward direction, detects a printing position of the image with respect to the reference marks based on the positions of the reference marks, sets a position in which to perform a cutting process with a cutting head, and performs a cutting process, the cutting method being characterized by including:

a first step of detecting the positions of the reference marks printed on the periphery of an other side image, of a plurality of the images, printed farthest to the other side in a conveying direction before starting a cutting process, wherein the conveying direction is parallel to the backward direction; and a second step of performing a cutting process for the other side image.

* * * * *